United States Patent [19]

Sairanen

[11] Patent Number: 5,034,660

[45] Date of Patent: Jul. 23, 1991

[54] METHOD OF AND APPARATUS FOR SUPPLYING HIGH FREQUENCY ALTERNATING CURRENT TO A FLUORESCENCE LAMP

[75] Inventor: Martti Sairanen, Espoo, Finland

[73] Assignee: Oy Helvar, Helsinki, Finland

[21] Appl. No.: 147,078

[22] Filed: Jan. 20, 1988

Related U.S. Application Data

[63] Continuation of Ser. No. 749,657, Jun. 28, 1985, abandoned, which is a continuation of Ser. No. 486,321, Apr. 19, 1983, abandoned.

[51] Int. Cl.[5] ..... H05B 37/00; H05B 41/36

[52] U.S. Cl. ..... 315/174; 315/176; 315/200 R; 315/209 R; 315/DIG. 5; 315/DIG. 7

[58] Field of Search ..... 315/DIG. 4, DIG. 5, 315/DIG. 7, 174, 200 R, 209 R, 353, 176

[56] References Cited

U.S. PATENT DOCUMENTS

| | | | |
|---|---|---|---|
| 3,525,900 | 8/1970 | Skirvin et al. . | |
| 4,234,823 | 11/1980 | Charlot . | |
| 4,277,728 | 7/1981 | Stevens | 315/DIG. 5 |
| 4,362,971 | 12/1982 | Sloan | 315/176 |
| 4,417,172 | 11/1983 | Touhou et al. | 313/567 |

FOREIGN PATENT DOCUMENTS

| | | |
|---|---|---|
| 075176 | 3/1983 | European Pat. Off. . |
| 085505 | 8/1983 | European Pat. Off. . |
| 2461449 | 7/1975 | Fed. Rep. of Germany . |
| 861181 | 2/1961 | United Kingdom . |
| 895970 | 5/1962 | United Kingdom . |
| 981066 | 1/1965 | United Kingdom . |
| 1208509 | 10/1970 | United Kingdom . |
| 1266130 | 3/1972 | United Kingdom . |
| 1487584 | 10/1977 | United Kingdom . |
| 1487585 | 10/1977 | United Kingdom . |
| 2049317 | 12/1980 | United Kingdom . |
| 2071950 | 9/1981 | United Kingdom . |
| 2106339 | 4/1983 | United Kingdom . |

*Primary Examiner*—Eugene R. LaRoche
*Assistant Examiner*—Michael B. Shingleton
*Attorney, Agent, or Firm*—Zarley, McKee, Thomte, Voorhees, & Sease

[57] ABSTRACT

A method of and apparatus for supplying high frequency alternating current to a fluorescence lamp. For eliminating a so-called striation phenomenon, a direct current component is induced in the high frequency alternating current passing through a lamp (8). The circuit means inducing said direct current component comprise a capacitor (3), connected in series with the lamp and having a diode (4) or the like connected in parallel therewith.

6 Claims, 1 Drawing Sheet

METHOD OF AND APPARATUS FOR SUPPLYING HIGH FREQUENCY ALTERNATING CURRENT TO A FLUORESCENCE LAMP

This is a continuation of co-pending application Ser. No. 749,657 (now abandoned), filed on June 28, 1985, which was a continuation of then co-pending, but now abandoned application Ser. No. 486,321, filed on Apr. 19, 1983.

In general terms, the invention relates to an inverter circuit effected by means of semi-conductors and applied in a mains connection device of fluorescence lamps for supplying current to the lamp.

Electronic mains connection devices for fluorescence lamps have recently been subject to a vigorous developing work. A common feature to all those devices is that a fluorescence lamp is charged with high frequency alternating current, ballasting of a current being thus more readily effected. An essential advantage of electronic connection devices over conventional iron core ballasts is superior efficiency.

One problem in the introduction of electronic connection devices is that fluorescence tubes, especially so-called thin 26 mm fluorescence tubes have visible successive darker and brighter areas. This so-called striation or swirling phenomenon does not lead to disturbances in actual illumination but its complete elimination should be desirable in visible fluorescence tubes. Particularly with adjustable electronic connection devices this problem is pronounced, and so-called thin fluorescence tubes have been considered impossible to adjust without the occurrence of said striation phenomenon.

This phenomenon is due to the superior efficiency achieved by using electronic connection devices; at a high frequency, the same light output is achieved by a lower current as that achieved by a higher current in conventional ballast application. As a result of a lower current, temperature of a lamp will remain lower.

An object of the invention is to provide a method of and an apparatus for eliminating said striation phenomenon.

This object is accomplished by the inventive features set forth in the appended claims.

Figure 1:
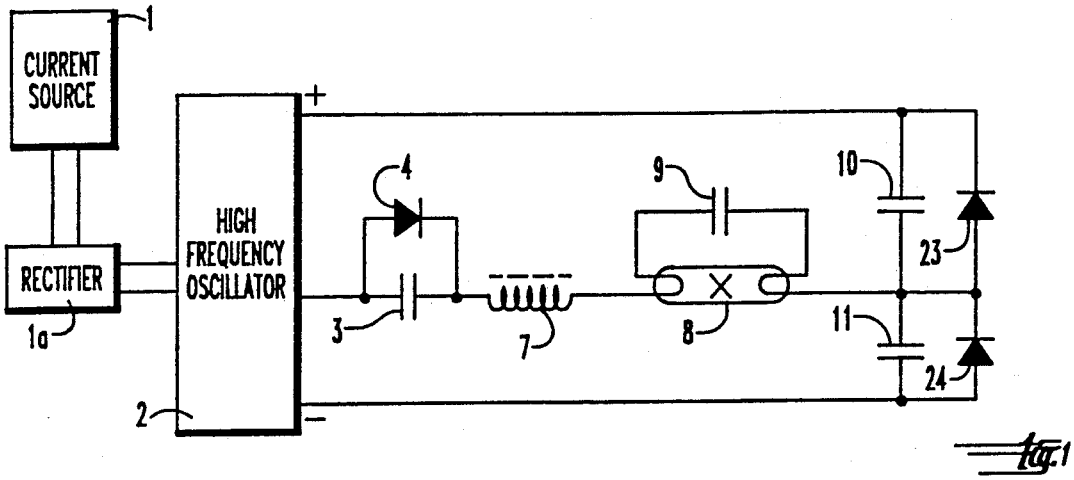

In the following, some embodiments of the invention are described with reference to the attached drawings in which FIG. 1 shows a first embodiment of the invention partly in block and partly in circuit diagram.

Figure 2:
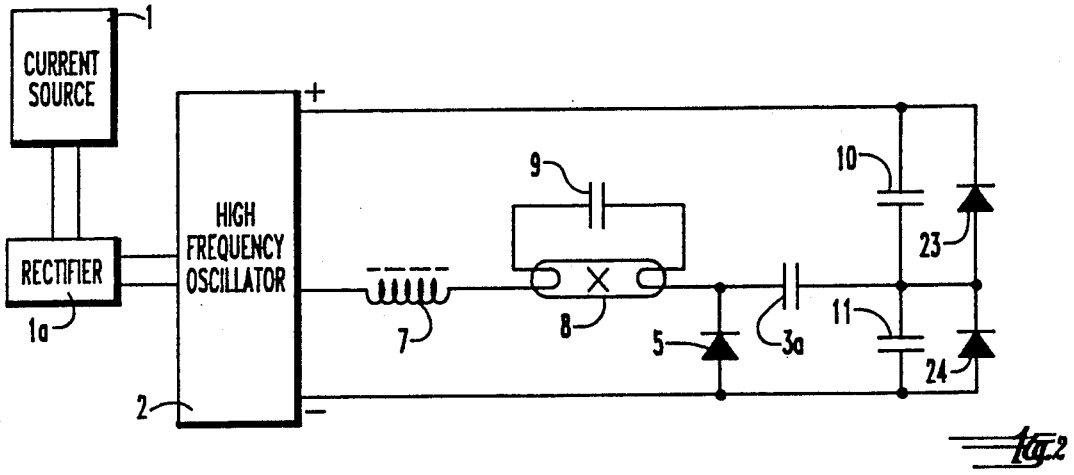

FIG. 2 shows a second embodiment of the invention, and

Figure 3:
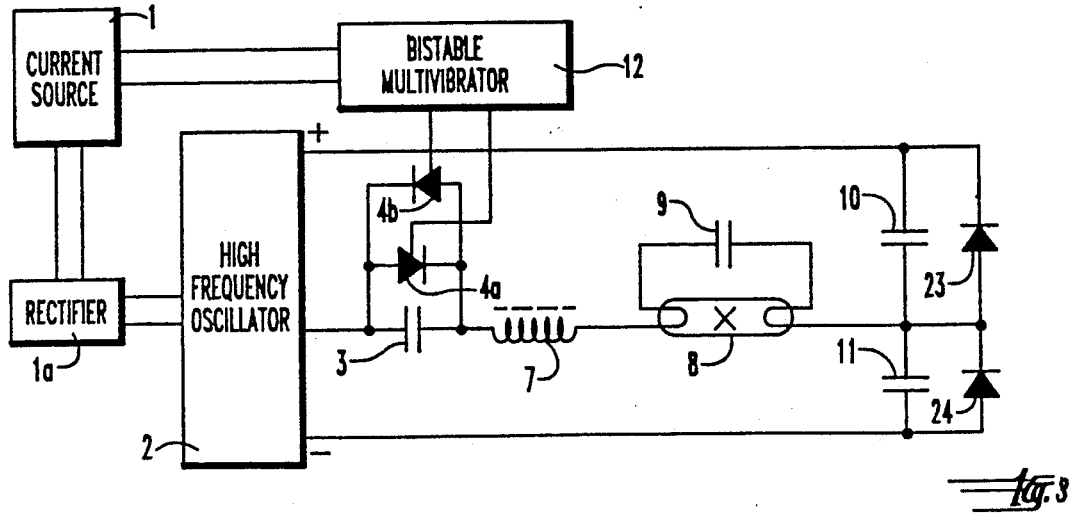

FIG. 3 a third embodiment of the invention.

Execution of the invention does not required any certain type of connection device as to its design and operation but, instead, the invention can be effected by means of all electronic connection devices that supply high frequency alternating current to a fluorescence lamp.

In the present application, the connection device described in the Applicant's earlier Finnish application nr. 820095 has been selected as a connection device by way of an example.

In that application, a source of alternating current 1 supplies by way of a rectifier 1*a* current to a connection device, wherein between direct current terminals + and − and a lamp 8 is provided a high frequency oscillator 2. The high frequency voltage switched on by oscillator 2 is passed by way of an induction winding (Ballast) 7 to one of the electrodes of lamp 8. The other electrode of lamp 8 is connected by means of resonance capacitors 10 and 11 as well as by means of voltage ballasting and stabilizing diodes 23 and 24 to the opposite terminals of a current source. In addition, parallel to lamp 8 is connected a capacitor 9 which during the starting operation prior to the ignition of a lamp, controls its share of operating frequency and lamp voltage. During the turn-on period of lamp 8, capacitors 10 and 11 form the substantial resonance capacitances in a free oscillating series resonance circuit which further includes the inductance provided by winding 7.

In order to avoid the above-mentioned striation phenomenon, the high frequency passing through lamp 8 is, according to the invention, provided with a direct current component by means of a circuit means, comprising a shunt connection formed by capacitor 3 and diode 4. A result of this is that amplitude of the current travelling in one direction will be substantially higher than that of the current travelling in the other direction, i.e. a direct current component is obtained. Practical experiments have surprisingly shown that by means of this direct current component said striation phenomenon can be eliminated virtually completely.

In the embodiment shown in FIG. 2, the circuit means that induce said direct current component comprise a capacitor 3*a* connected in series with lamp 8 as well as a diode 5 connected to one of the direct current terminals from a point 6 between said capacitor and the lamp electrode. Also in this case, amplitude of the current travelling in one direction will be higher than that of the current travelling in the opposite direction.

Instead of passive diodes 4 and 5 it is also possible to employ actively controlled switch elements, an example of such being shown in FIG. 3. In that embodiment, a capacitor 3 has been parallelled with oppositely directed thyristors 4*a* and 4*b*, controlled by means of a bistable multivibrator 12 in a manner that thyristors 4*a* and 4*b* are alternately for a certain period conductive while the other one is non-conductive. This way the direction of a direct current component can be reversed periodically, duration of a reversal cycle being multiple with respect to the duration of a high frequency alternating current cycle. This reversal of a direct current component serves to gain the advantage that both cathodes of a lamp are subjected to uniform wear which prolongs the life of a lamp.

It is to be appreciated that the above embodiments are just examples of the application of the present invention and a skilled person will be able to find many other applications for the invention within the scope of the appended claims.

I claim:

1. A method of supplying high frequency alternating current to a fluorescence lamp (8), said method comprising the use of a series resonance circuit (7; 10, 11) to which said lamp (8) is coupled, characterized in that a direct current compoent is induced in the high frequency alternating current of resonance circuit (7; 10, 11) whereby said high frequency alternating current with said direct current component is passing through said lamp (8), and whereby the direction of a direct current component is periodically reversed, the duration of a reversal cycle being multiple with respect to that of a high frequency alternating current cycle.

2. A method as set forth in claim 1, characterized in that the amplitude and/or duration of the current cycles travelling in one direction are made to substantially exceed the amplitude and/or duration of the current cycles travelling in the other direction.

3. A method as set forth in claim 2, characterized in that the direction of a direct current component is periodically reversed, the duration of a reversal cycle being multiple with respect to that of a high frequency alternating current cycle.

4. An apparatus for supplying high frequency alternating current to a fluorescence lamp (8), said apparatus comprising a high frequency generator (2) and a series resonance circuit which includes a ballast (7) and a capacitor (10, 11), said lamp (8) being connected in series to said resonance circuit, characterized by circuit means (3, 4; 3*a*, 5; 3, 4*a*, 4*b*) connected to a lamp circuit and inducing a direct current component in the high frequency alternating current whereby said high frequency alternating current with said direct current component is passing through said lamp (8), said circuit means being provided with a capacitor (3, 3*a*) connected in series with a lamp, with one or more diodes (4; 5) or a controlled switch means (4*a*, 4*b*) connected in parallel with said capacitor.

5. A method of supplying high frequency alternating current to a low pressure fluorescence lamp (8) for eliminating striation therein, said method comprising the use of a series resonance circuit (7; 10, 11) to which said lamp (8) is coupled, characterized in that a direct current component is induced in the high frequency alternating current of said resonance circuit (7, 10, 11) whereby said high frequency alternating current with said direct current component is passing through said lamp (8), said direct current component being induced by the energy which is stored in a capacitor (3, 3*a*) during every second half cycle of the high frequency alternating current traveling in one direction and discharged from the capacitor during the half cycles in the other direction, the capacitor (3, 3*a*) being connected in parallel with a shunting means (4; 4*a*, 4*b*; 5).

6. A method of supplying high frequency alternating current to a low pressure fluorescence lamp (8) for eliminating striation therein, said method comprising the use of a high frequency alternating current circuit including an inductor (7) and a capacitor (10, 11) in series with said lamp (8), characterized in that a direct current component is induced in the high frequency alternating current of said current (7, 10, 11) whereby said high frequency alternating current with said direct current component is passing through said lamp (8), said direct current component being induced by the energy which is stored in a capacitor (3, 3*a*) during every second half cycle of the high frequency alternating current traveling in one direction and discharged from the capacitor during the half cycles in the other direction, the capacitor (3, 3*a*) being connected in parallel with a shunting means (4; 4*a*, 4*b*; 5).

* * * * *